United States Patent [19]

Terayama et al.

[11] 3,980,156

[45] Sept. 14, 1976

[54] DEVICE FOR PREVENTING JUTTING-OUT OF LADDER OF LADDER TRUCK

[75] Inventors: Fusaji Terayama; Seiichi Nakagawa, both of Osaka, Japan

[73] Assignee: Morita Pump Kabushiki Kaisha, Osaka, Japan

[22] Filed: Aug. 25, 1975

[21] Appl. No.: 607,552

[52] U.S. Cl. ..... 182/66; 182/211

[51] Int. Cl.[2] ..... E06C 5/06; E06C 7/06

[58] Field of Search ..... 182/212, 213, 209, 210, 182/211, 66, 67

[56] References Cited

UNITED STATES PATENTS

| | | | |
|---|---|---|---|
| 1,949,972 | 3/1934 | Murphy | 182/212 |
| 3,083,789 | 4/1963 | Herterich | 182/212 |

*Primary Examiner*—Reinaldo P. Machado
*Attorney, Agent, or Firm*—Hall & Houghton

[57] ABSTRACT

There is provided a device for preventing the jutting-out of the ladder of a ladder truck, wherein when the extending and contracting operation of an extensible ladder is completed and a ladder extending and contracting changeover valve is returned to its neutral position, locking levers are automatically turned to their locking position with respect to several stage ladders required to be prevented from jutting out, thereby providing for prevention of jutting-out, whereas at the time of extension and contraction of the extensible ladder said locking levers are turned to their retracted position to enable the extension and contraction to be effected without hindrance.

2 Claims, 4 Drawing Figures

DEVICE FOR PREVENTING JUTTING-OUT OF LADDER OF LADDER TRUCK

BACKGROUND OF THE INVENTION

1. Field of the Invention

The present invention relates to a device for preventing the jutting-out of the ladder of a ladder truck. More particularly, in a ladder truck equipped with an extensible ladder of the type in which several stage ladders in the upper stages are successively withdrawn from the stage ladders in the lower stages by a wire rope to extend them and in which the retraction of the stage ladders is effected by unwinding said rope with extensible ladder erected so as to allow the stage ladders to be retracted under their own weight, if the truck running with the extensible ladder retracted and lying flat is suddenly braked, said several stage ladders in the upper stage will jut out by inertia. The present invention is intended to prevent such jutting out.

2. Description of the Prior Art

The conventional jutting-out preventing device comprises an L-shaped lever pivotally mounted on a ladder support on a truck frame so that when the ladder is prostrated onto the ladder support, the lower surface of the ladder abuts against and depresses one arm of said lever to turn the lever under the weight of the ladder until the other arm swings upwardly through an opening defined by ladder crosspieces into abutment against the front side of a row of crosspieces of the superposed stage ladders to prevent jutting out. According to this device, if the stage ladders are completely retracted, there will be no problem since the fixedly spaced ladder crosspieces are then vertically aligned in horizontally spaced rows, but if the retraction of the stage ladders is incomplete, the ladder crosspieces are then not vertically aligned, so that there is no problem of the projecting crosspieces being broken by the lever arm, making it impossible to prevent jutting out.

SUMMARY OF THE INVENTION

The present invention provides a device for preventing the jutting-out of the ladder of a ladder truck, comprising locking means including a lever shaft transversely extending outside the receiving side of the stage ladders and mounted on the lowermost stage ladder which does not extend or retract, and locking levers mounted on said shaft and associated with locking portions provided on the stage ladders required to be prevented from jutting out, lever actuating means including an operating cylinder attached to the lowermost stage ladder and having a rod connected to one of said locking levers so that the extension and retraction of said rod causes said locking levers to be swung between a locking position and a retracted position, and a directional control valve associated with a ladder extension and contraction changeover valve and adapted to switch the hydraulic circuit of said cylinder in connection with changeover of said changeover valve between its neutral position and its ladder extension and contraction positions, the arrangement being such that the locking levers are maintained in their retracted position during ladder extension and contraction operation whereas they are turned to their locking position when ladder extension and contraction operation is stopped. The present invention is characterized in that when the ladder extension and contraction changeover valve is brought to its neutral position with the stage ladders completely retracted, the lever actuating cylinder is actuated, whereupon the locking levers are automatically brought to their locking position to prevent jutting out. Further, at the time of ladder extension and contraction operation, the locking levers are automatically turned to their retracted position in connection with the switching of the changeover valve, thereby preventing the jutting-out of the stage ladders. What deserves special mention is the fact that it is possible to employ a relief and chusion mechanism whereby even if the locking levers are actuated for locking operation with the stage ladders in an incompletely retracted position, damage to the locking members and the operating cylinder can be avoided.

BRIEF DESCRIPTION OF THE DRAWINGS

In the accompanying drawings illustrating a preferred embodiment of the present invention.

DESCRIPTION OF THE PREFERRED EMBODIMENT

Figure 1:
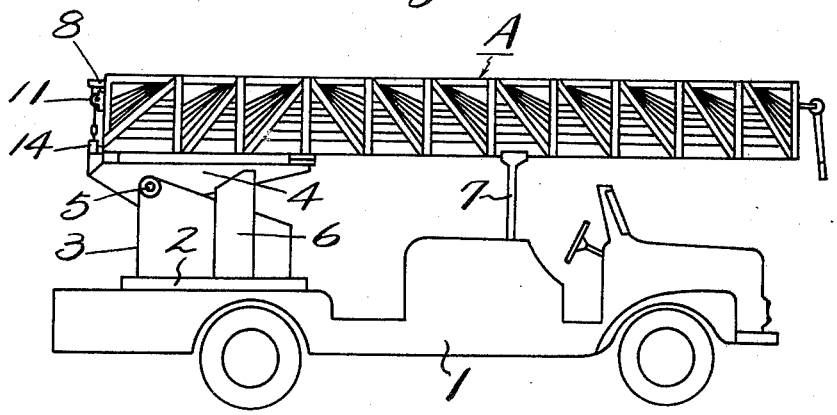
FIG. 1 is a side view of a ladder truck.
Figure 2:
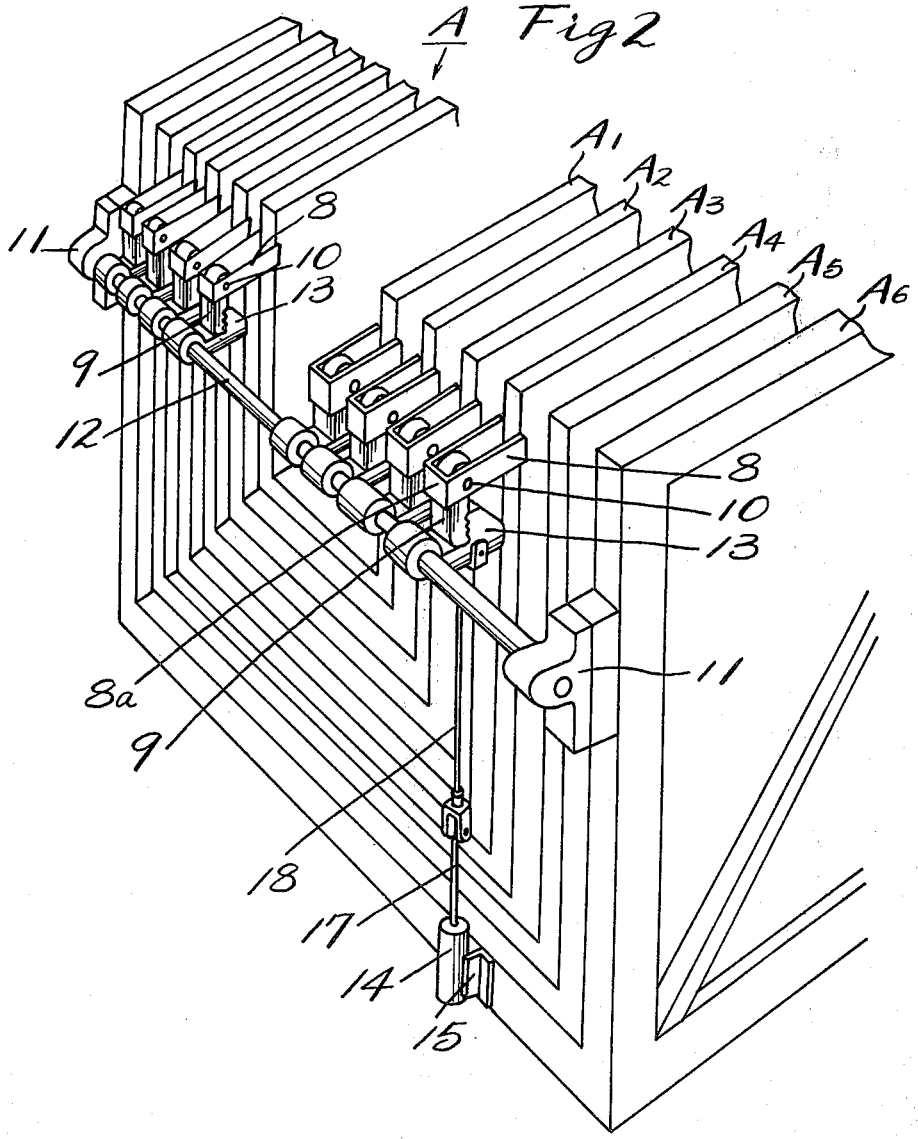
FIG. 2 is a perspective view of a locking lever attaching region at the rear end of stage ladders.

In FIG. 1, the character 1 designates the body of a ladder truck; 2, a turntable mounted on the rear portion of said body; 3, a ladder frame mounted on said turntable; and 4 designates an extensible ladder which is pivotally mounted on the frame 3 by a pin 5 through a tilt correcting frame 4. Designated at 6 is a control tower and at 7 is a ladder support. An extensible ladder A is shown as one of the 6-stage type in which, as shown in FIG. 2, channel-shaped stage ladders $A_1$, $A_2$, $A_3$, $A_4$, $A_5$ and $A_6$ of the same length but successively increasing width are telescopically fitted together for extension and retraction through rollers (not shown). The ladder A is raised and lowered by a raising and lowering cylinder disposed between the frames 3 and 4. The extension of the extensible ladder is effected in its erected position by extending an extension and retraction cylinder disposed between the lowermost stage ladder $A_6$ and the fifth stage ladder $A_5$ to cause a pulley at the front end of the fifth stage ladder $A_5$ to push the intermediate portion of an extension and retraction wire rope of predetermined length tied between the front portion of the lowermost stage ladder $A_6$ and the rear portion of the fourth stage ladder $A_4$, thereby extending the fourth stage ladder $A_4$ concurrently with the fifth stage ladder $A_5$ and through the same distance as the latter. The third stage ladder $A_3$ is extended by a pulley at the front portion of the fourth stage ladder $A_4$ which pushes the intermediate portion of an extension and retraction wire rope tied between the front portion of the fifth stage ladder $A_5$ and the rear portion of the third stage ladder $A_3$. The second and first stage ladders are likewise extended by rope arrangements similar to those described above. When the extensible ladder is to be retracted, said extension and retraction cylinder is retracted with the ladder A erected, whereby the extension and retraction wire ropes of the stage ladders $A_1$, $A_2$, $A_3$ and $A_4$ are slackened to allow the stage ladders to be retracted under their own weight. According to this extension and retraction system, if the ladder truck running with the extensible ladder retracted and lying flat on the support 7 is suddenly braked, the stage ladders $A_1$, $A_2$, $A_3$ and $A_4$ in the first, second, third and fourth stages, respectively, will jut out. To prevent this, the following jutting-out preventing device is provided.

Figure 3:
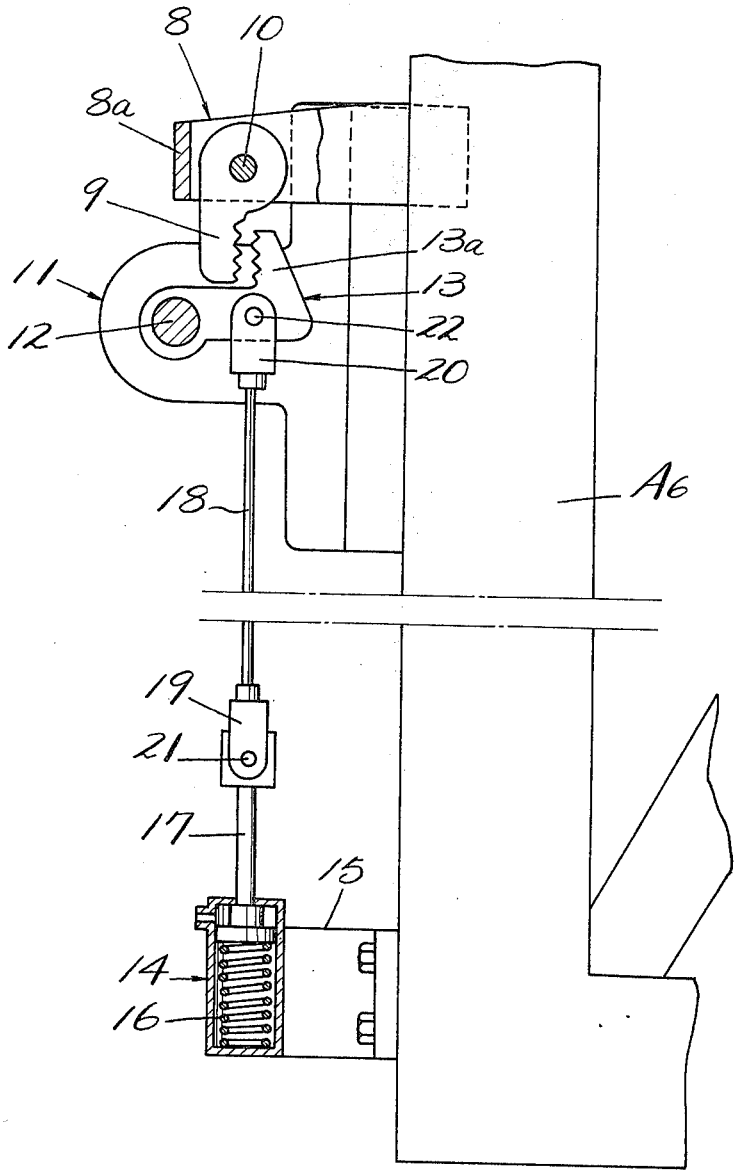
FIG. 3 is a longitudinal section of a lever actuating cylinder attaching region.
Figure 4:
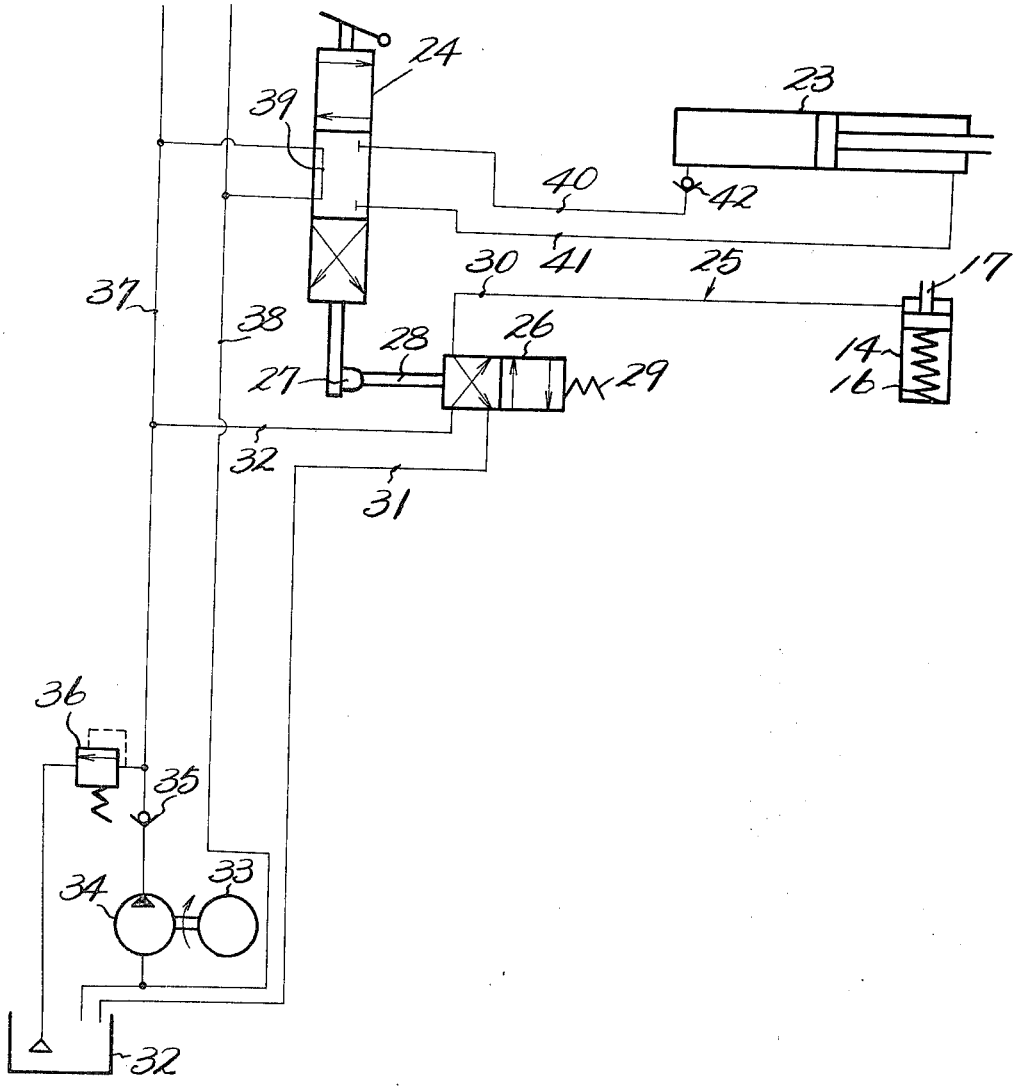
FIG. 4 is a view showing a hydraulic circuit for the lever actuating cylinder.

Frame-shaped brackets 8 are firmly secured to the upper rear end portions of opposite side frames of the stage ladders $A_1$, $A_2$, $A_3$ and $A_4$ so that they rearwardly extend therefrom and are vertically opened. Each bracket 8 has a locking element 9 pivotally mounted on and suspended from a transverse pin 10 at the front portion thereof. The locking element 9 is associated with a bracket top plate 8*a* serving as a stop and is thereby prevented from being turned rearwardly from its vertically suspended position but it is capable of forwardly turning to its retracted position within the bracket. Bearings 11 are attached to the rear ends of the opposite side frames of the sixth stage ladder $A_6$ which does not extend or retract, and a lever shaft 12 is supported in a transverse position between said bearings. Locking levers 13 are fixed side by side on said shaft 12 so as to be opposed to said locking elements 9 in the direction of extension and retraction of the extensible ladder. Each locking lever 13, as shown in FIG. 3, is formed with a hook portion 13*a* which assumes its vertical position in front of the looking element 9 with a clearance maintained therebetween to ensure unimpeded downward turning of the locking lever. The engagement surfaces of the locking member and locking element are formed with irregularities which mesh with each other when the locking member and locking element abut against each other to ensure firm engagement therebetween. A locking lever actuating cylinder 14 is vertically installed on the rear lower end surface of the lowermost stage ladder $A_6$ by a bracket 15. The cylinder is of the single-acting type having a coiled spring 16 installed therein in a compressed state on the head side. A piston rod 17 and one locking lever 13 immediately thereabove are bendably connected together by a link 18, so that when said one lever 13 is turned, the lever shaft 12 is turned, which means that all the locking levers 13 are simultaneously turned. A spring 16 constantly urges the piston rod 17 to maintain the latter in an extended condition, where the locking levers 13 assume the illustrated locking position. When high pressure oil is supplied to the cylinder 14 on its rod side to retract the rod 17, the locking levers 13 are downwardly pulled into their retracted position. The characters 19 and 20 designate joints and 21 and 22 designate their pins. As shown in FIG. 4, an extension and retraction changeover valve 24 for a ladder extension and retraction cylinder 23 is associated with a directional control valve 26 placed in a hydraulic circuit 25 for the lever actuating cylinder 14. A cam 27 is attached to the spool of the extension and retraction changeover valve 24 and an actuating bar 28 is attached to the spool of the directional control valve 26, and they are associated with each other in the following manner.

When the valve 24 is in its neutral position, the actuating bar 28 and spool of the valve 26 are urged to the right against the force of a spring 29 by the cam 27, so that ports to a cylinder line 30 and a low pressure line 31, respectively, communicate with each other, whereupon the oil in the cam actuating cylinder 14 is returned to an oil tank 32, thereby allowing the piston rod 17 to extend to turn the locking levers 13 to their locking position. On the other hand, when the valve 24 is changed over to the ladder extending or retracting side, the cam 27 is disengaged from the actuating bar 28, allowing the spool of the valve 26 to be moved to the left under the action of the spring 29, thereby establishing communication between ports to the cylinder line 30 and to a high pressure line 32, respectively, whereupon high pressure oil is supplied to the rod side of the cylinder 14 to turn the locking levers 13 to their retracted position. The character 33 designates a motor; 34, a hydraulic pump; 35, a check valve; 36, a safety valve; and 37 designates a high pressure line from which the above mentioned line 32 branches off. The character 38 designates a low pressure line and 39 designates a center bypass circuit serving to return high pressure oil to the tank 32 when the valve 24 is in its neutral position. The characters 40 and 41 designate cylinder lines and 42 designates a check valve.

According to the above arrangement, when the extensible ladder is extended and retracted, all the locking levers 13 are turned to their retracted position by the ladder extension and retraction changeover valve 24, thereby allowing the extensible ladder to be extended and retracted without hindrance. Further, if the extension and retraction changeover valve 24 is brought to its neutral position with the extensible ladder extended to any desired length, all the locking levers are turned to their locking position, but there is no hindrance to the operation since the locking elements 9 on the stage ladders $A_1$, $A_2$, $A_3$ and $A_4$ are spaced away forwardly of the associated locking levers 13. When the extension and retraction changeover valve 24 is brought to its neutral position with the extensible ladder completely retracted upon completion of the operation, the locking levers 13 are turned to assume a position in front of the corresponding locking elements 9, thereby preventing jutting out. If the extension and retraction changeover valve should be returned to its neutral position with the extensible ladder incompletely retracted resulting in the front ends of the locking levers 13 abutting against the front lower surfaces of the locking elements 9, the locking elements 9 will be turned to their retracted position or the locking levers 13 will not be further turned owing to the insufficient upward push thereon exerted by the spring 16, so that there will be no damage to the locking members.

What is claimed is:

1. A device for preventing the jutting-out of the ladder of a ladder truck, comprising locking portions provided on stage ladder required to be prevented from jutting out, locking levers corresponding to said locking portions installed on the lowermost stage ladder which does not extend or retract, an operating cylinder for turning said locking levers between a locking position and a retracted position, a directional control valve disposed adjacent a ladder extension and retraction changeover valve whereby the hydraulic circuit of said cylinder is switched in connection with the switching of said changeover valve between a neutral position and ladder extending and retracting positions, the arrangement being such that at the time of ladder extending and retracting operation, the locking levers are turned to their retracted position, whereas at the time of stoppage of ladder extending and retracting operation, the locking levers are turned to their locking position.

2. A device for preventing the jutting-out of the ladder of a ladder truck as set forth in claim 1, wherein the locking levers are mounted on a lever shaft transversely supported on both sides of the rear end surface of the lowermost stage ladder so as to be associated with the corresponding locking portions, the locking portions being in the form of locking elements suspended by transverse pins from brackets projecting from the rear end surfaces of the stage ladders in such a manner that the locking levers will not rearwardly turn but are capable of turning to their retracted position, the cylinder being of the single-acting type having a compression spring installed therein on the head side, the piston rod of said cylinder and one locking lever being connected together by a link in such a manner that when the rod is extended by the compression spring, the locking levers assume their locking position whereas when pressure oil is supplied to the cylinder on the rod side, the locking levers are turned to their retracted position.

* * * * *